US010336493B2

(12) United States Patent
Gatteschi

(10) Patent No.: US 10,336,493 B2
(45) Date of Patent: Jul. 2, 2019

(54) DEVICE AND PROCESS FOR APPLYING GRIPPING HANDLES ON PACKAGING FILMS, AND SHRINKWRAP PACKER PROVIDED WITH SUCH A DEVICE

(71) Applicant: OCME S.R.L., Parma (IT)

(72) Inventor: Emanuele Gatteschi, Poppi (IT)

(73) Assignee: OCME S.R.L., Parma (IT)

( * ) Notice: Subject to any disclaimer, the term of this patent is extended or adjusted under 35 U.S.C. 154(b) by 348 days.

(21) Appl. No.: 15/022,504

(22) PCT Filed: Sep. 15, 2014

(86) PCT No.: PCT/IB2014/064522
§ 371 (c)(1),
(2) Date: Mar. 16, 2016

(87) PCT Pub. No.: WO2015/036980
PCT Pub. Date: Mar. 19, 2015

(65) Prior Publication Data

US 2016/0229576 A1 Aug. 11, 2016

(30) Foreign Application Priority Data

Sep. 16, 2013 (IT) ..... MI2013A1525

(51) Int. Cl.
*B65B 61/00* (2006.01)
*B65B 13/00* (2006.01)
(Continued)

(52) U.S. Cl.
CPC ..... *B65B 61/14* (2013.01); *B65B 13/185* (2013.01); *B65B 21/24* (2013.01); *B65B 41/16* (2013.01);
(Continued)

(58) Field of Classification Search
CPC ..... B65B 61/14; B65B 13/185; B65B 21/24; B65B 41/16; B65B 53/02; B65D 65/02;
(Continued)

(56) References Cited

U.S. PATENT DOCUMENTS 3,557,516 A 1/1971 Brandt
4,830,895 A 5/1989 Bernard
4,906,319 A 3/1990 Fiorani

FOREIGN PATENT DOCUMENTS

CN 201800942 U 4/2011
CN 102530328 A 7/2012
(Continued)

OTHER PUBLICATIONS

Chinese Patent Office, Office Action for Application No. 20140050447.8, dated Dec. 13, 2016.
(Continued)

*Primary Examiner* — Linda L Gray
(74) *Attorney, Agent, or Firm* — Ice Miller LLP

(57) ABSTRACT

The present invention concerns a device (1) for applying gripping handles (M) on films (P), being supplied on shrinkwrap packers (2) for making bundles of bottles (B), cans and/or similar containers (B). The device (1) comprises: an applying head (10) provided with a roller (11) for applying gripping handles (M); an abutment mechanism (14) for operatively supporting a series of heat-shrinkable packaging films (P), being supplied on a respective shrinkwrap packer (2). The applying roller (11) and the abutment mechanism (14) are mobile with respect to one another between a non-operating condition, in which they are spaced apart, and an operating condition, in which the applying roller (11) is arranged, at the abutment mechanism (14), against at least one of the films (P) being supplied to apply a respective gripping handle (M) on the latter. The abutment mechanism (14) comprises a supporting tape (15) having an advance-
(Continued)

ment surface (16) for advancing the films (P), which, in the operating condition, provides an abutment for the applying roller (11), which applies each handle (M) on a respective packaging film (P), acting against the advancement surface (16) of the supporting tape (15).

6 Claims, 8 Drawing Sheets

(51) Int. Cl.

| | |
|---|---|
| ***B65B 21/00*** | (2006.01) |
| ***B65B 41/00*** | (2006.01) |
| ***B65D 65/00*** | (2006.01) |
| ***B65D 71/00*** | (2006.01) |
| ***B65B 61/14*** | (2006.01) |
| ***B65B 13/18*** | (2006.01) |
| ***B65B 21/24*** | (2006.01) |
| ***B65B 41/16*** | (2006.01) |
| ***B65B 53/02*** | (2006.01) |
| ***B65D 65/02*** | (2006.01) |
| ***B65D 71/08*** | (2006.01) |

(52) U.S. Cl.
CPC ..... *B65B 53/02* (2013.01); *B65D 65/02* (2013.01); *B65D 71/08* (2013.01); *Y10T 156/1062* (2015.01); *Y10T 156/1074* (2015.01); *Y10T 156/1075* (2015.01); *Y10T 156/1322* (2015.01); *Y10T 156/1343* (2015.01)

(58) Field of Classification Search
CPC ..... B65D 71/08; Y10T 156/125; Y10T 156/1322; Y10T 156/1343; Y10T 156/1062; Y10T 156/1074; Y10T 156/1075
See application file for complete search history.

(56) References Cited

FOREIGN PATENT DOCUMENTS

| | | |
|---|---|---|
| DE | 102005041650 A1 | 3/2007 |
| GB | 2271098 A | 4/1994 |

OTHER PUBLICATIONS

PCT/IB2014/064522, European Patent Office, International Search Report of the International Searching Authority, dated Nov. 28, 2014.

PCT/IB2014/064522, European Patent Office, Written Opinion of the International Searching Authority, dated Nov. 28, 2014.

DEVICE AND PROCESS FOR APPLYING GRIPPING HANDLES ON PACKAGING FILMS, AND SHRINKWRAP PACKER PROVIDED WITH SUCH A DEVICE

CROSS-REFERENCE TO RELATED APPLICATIONS

The present application is a U.S. national stage of, and claims the priority benefit of, International Patent Application Serial No. PCT/IB2014/064522, filed Sep. 15, 2014 and Italian Patent Application Serial No. MI2013A001525, filed Sep. 16, 2013, the text and drawings of which are hereby incorporated by reference in their entireties.

The present invention refers to a device for applying gripping handles on packaging films, preferably heat-shrinkable ones, being supplied on shrinkwrap packers for making bundles of bottles, cans and/or similar containers.

The present invention also concerns a method for applying gripping handles on packaging films, preferably heat-shrinkable ones, being supplied on shrinkwrap packers for making bundles of bottles, cans and/or similar containers.

An object of the present invention is also a shrinkwrap packer for making bundles of bottles, cans and/or similar containers.

The present invention lends itself to being used in the industrial field of machines and devices for packaging bottles, jars and/or similar containers for products of any type, in particular food and drink products.

As known, the packaging of bottles, cans and/or similar containers is generally carried out by means of shrinkwrap packers that collect and wrap a predetermined number of containers with appropriate packaging films in the form of continuous tape usually made of a heat-shrinkable plastic material.

The wrapping of the aforementioned groups of containers determines the formation of so-called bundles that facilitate transportation and/or storage.

Normally, the aforementioned bundles are provided with suitable gripping handles that can be applied to the packaging films both after and before the formation thereof.

In order to speed up the packaging processes, it is common practice to apply the gripping handles directly onto the packaging films before carrying out the wrapping of the containers to be packaged.

The operation of applying the gripping handles to the packaging films is normally carried out by means of respective application devices that are mounted on the shrinkwrap packers. Such application devices usually comprise a mobile applying head provided with a respective applying roller that operates directly in contact with the packaging films being supplied.

The applying roller is suitably supplied with a plurality of gripping handles, also in the form of continuous tape, to be applied to the respective packaging films being supplied.

In order to provide a suitable abutment surface for the applying roller during the fixing of the gripping handles on the packaging films, the application device also provides a suitable abutment roller that suitably supports the packaging films being supplied. The packaging films are supported, at least partially, by the abutment roller so as to be able to receive in engagement the applying roller that, during the application of the gripping handle, exerts a pressure against the abutment roller.

Although the current application techniques of gripping handles to packaging films used for the formation of bundles allow a sufficient joining between them, the Applicant has found that they have however some drawbacks and they can be improve in various ways, mainly in relation to the quality of the joinings between the packaging films and the gripping handles, to the structural integrity of the bundles made, especially at the joining areas between the packaging films and the gripping handles, to the structural integrity of the packaging films during the application of the gripping handles, to the speed of application of the gripping handles on the packaging films and, consequently, to the overall production times of the bundles, as well as to the overall manufacturing and production costs thereof.

In particular, the Applicant has found that the application of the gripping handles by means of an applying roller that acts on the packaging films against a respective abutment roller does not ensure a good adherence between the gripping handles and the films themselves, especially at high advancement velocities of the packaging films. In fact, the application of the gripping handles to the packaging films according to conventional methods involves the formation of various transversal wrinkles at the joining areas between them.

The undesired presence of the aforementioned transversal wrinkles significantly reduces the adhesion between the gripping handles and the packaging films and, consequently, the stability and strength of the structures formed. In other words, the joins obtained cannot ensure the adhesion of the gripping handles to the packaging films when they are subjected to the normal stresses generated during the manipulation of the bundles. Therefore, the presence of the aforementioned transversal wrinkles results in the frequent detachment of the gripping handles from the respective bundles with negative consequences.

It should also be considered that the exploitation of the abutment roller during the application of the aforementioned gripping handles can, depending on the production speeds used, deform or even tear the packaging films at the joining areas. In fact, the gripping handles that remain immobile until they make contact with the packaging films, undergo a sudden acceleration once intercepted by them. On the other hand, the gripping handles tend to rapidly brake the intercepted packaging films that can permanently deform or even break.

In order to reduce the risks of deformation and/or breaking of the packaging films with the consequent stopping of the shrinkwrap packers to eliminate the unusable waste, as well as the formation of excessive transversal wrinkles in the joining areas between the gripping handles and the packaging films, it is necessary to considerably slow down the overall application speed of the gripping handles. However, such a reduction in speed has a negative impact upon the overall production speed of the bundles, as well as on the overall costs for manufacturing and forming them.

The main purpose of the present invention is to propose a device and a method for applying gripping handles on packaging films, preferably heat-shrinkable ones, being supplied on shrinkwrap packers for making bundles of bottles, cans and/or similar containers, and a shrinkwrap packer provided with such an application device, capable of solving the problems encountered in the prior art.

A purpose of the present invention is to ensure excellent adherence of the gripping handles to the packaging films.

A further purpose of the present invention is to avoid the formation of transversal wrinkles between the gripping handles and the packaging films at the joining areas between them, also at high application and production speeds.

It is also a purpose of the present invention to increase the structural strength of the bundles made at the joins between the gripping handles and the packaging films.

It is also a purpose of the present invention to ensure the structural integrity of the packaging films during the application of the gripping handles avoiding the permanent deformation and undesired breaking or tearing thereof.

It is also a purpose of the present invention to ensure the continuity of the application process of the gripping handles to the packaging films and avoid the interruption thereof.

A further purpose of the present invention is to ensure high application speeds of the gripping handles to the packaging films.

Another purpose of the present invention is to reduce the production time of the bundles.

Finally, another purpose of the present invention is to reduce the overall production costs of the bundles.

The purposes specified above, and others still, are substantially accomplished by a device and a method for applying gripping handles on packaging films, preferably heat-shrinkable ones, being supplied on shrinkwrap packers for making bundles of bottles, cans and/or similar containers, and a shrinkwrap packer provided with such an application device, as expressed and described in the following claims.

As an example, it will now be given the description of a preferred but not exclusive embodiment of a device and a method for applying gripping handles on packaging films, preferably heat-shrinkable ones, being supplied on shrinkwrap packers for making bundles of bottles, cans and/or similar containers, and a shrinkwrap packer provided with such an application device, in accordance with the present invention.

The description will be made hereafter with reference to the attached drawings, provided for indicating and therefore not limiting purposes, in which.

Figure 3:
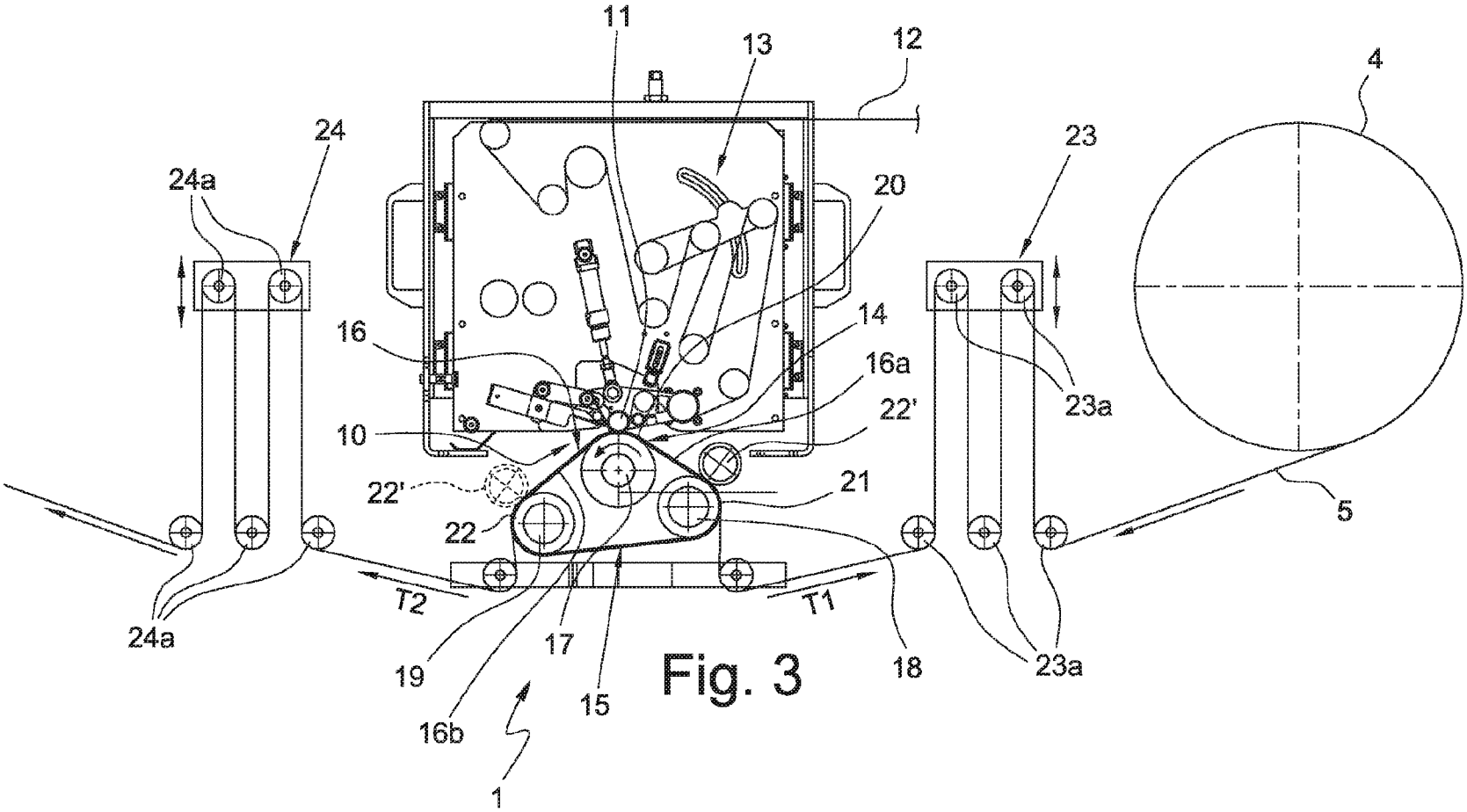
FIG. 3 is a schematic view of the gripping device mounted on the shrinkwrap packer according to FIGS. 1 and 2.
Figure 5A:
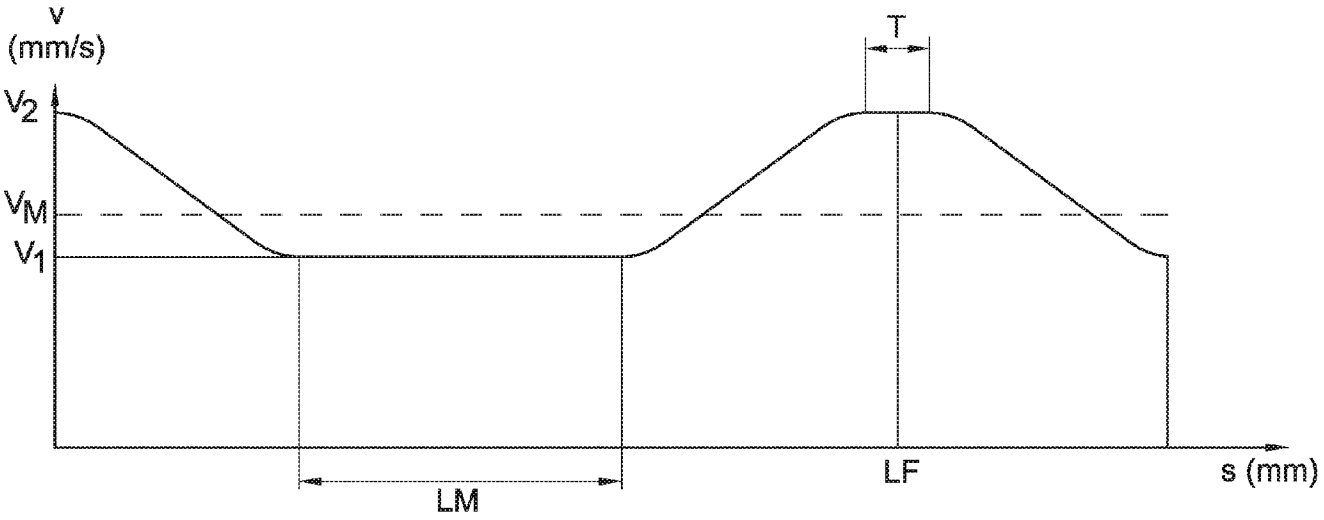
Figure 5B:
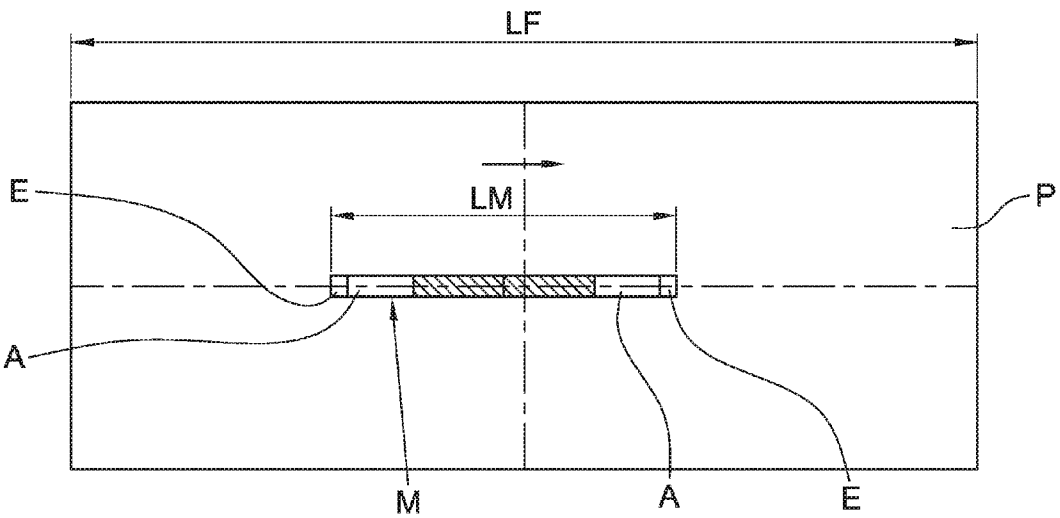
Figure 5D:
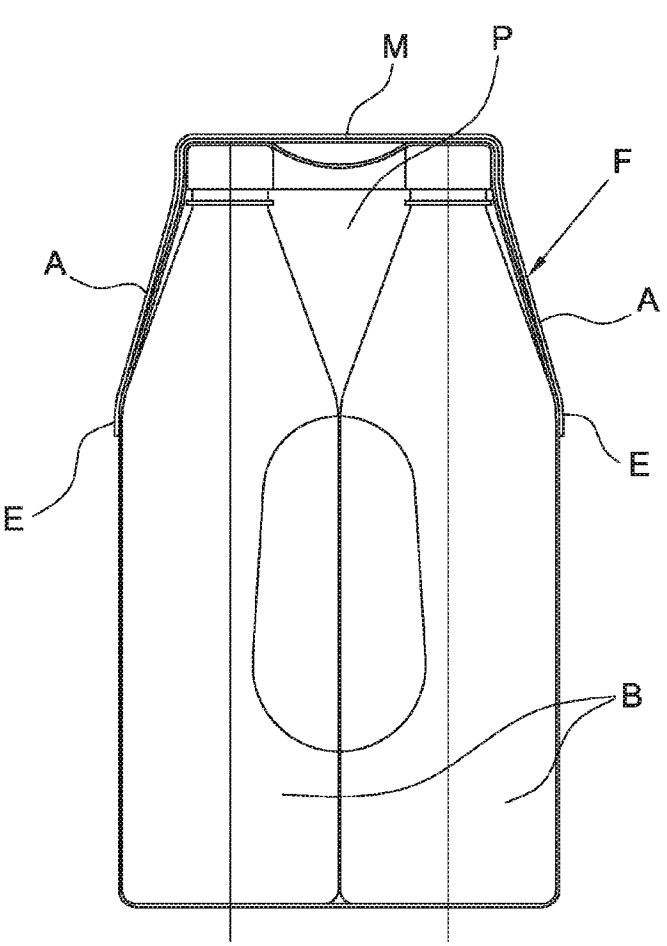
Figure 5C:
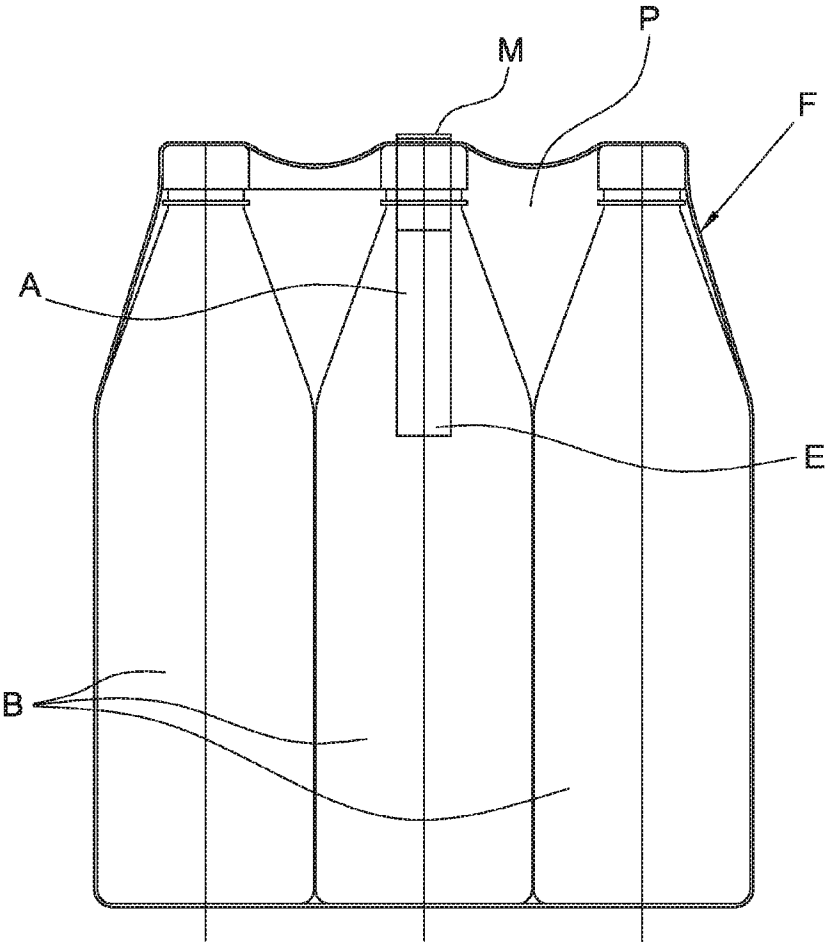

FIG. 5*a* is the representation of a first graph relative to the velocity variations of a supporting tape of the application device according to FIG. 3 during the application of the gripping handles to the respective packaging films for the formation of a first example embodiment of a bundle;

FIG. 5*b* is a schematic representation in plan of a packaging film P, corresponding to the graph according to FIG. 5*a*, provided with a respective gripping handle;

FIG. 5*c* is a side view of the first example embodiment of the bundle corresponding to the graph according to FIG. 5*a* and to the film according to FIG. 5*b;*

FIG. 5*d* is a front view of the bundle according to FIG. 5*c;*

Figure 6A:
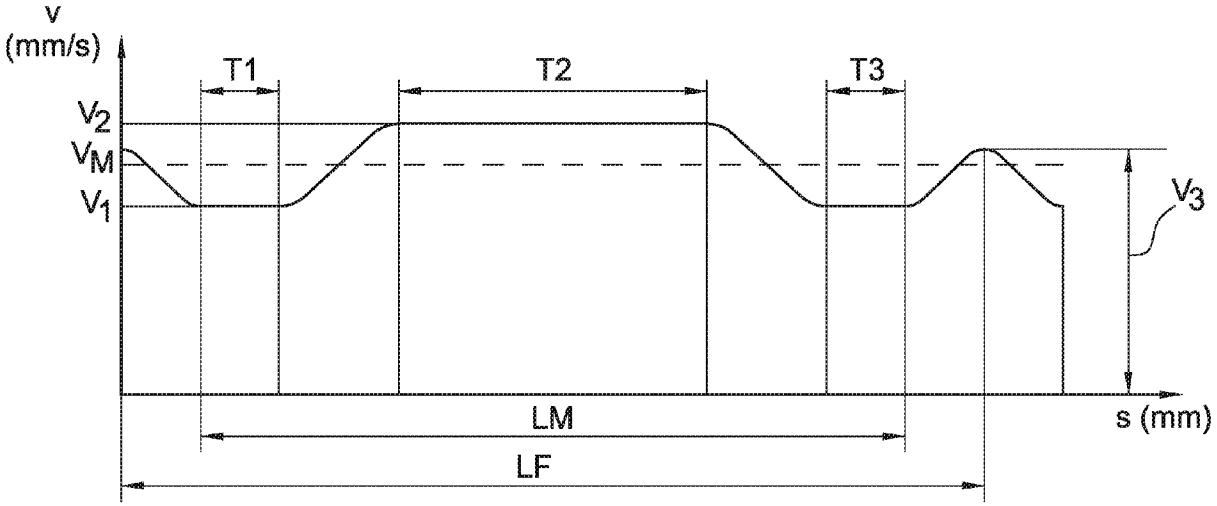
Figure 6B:
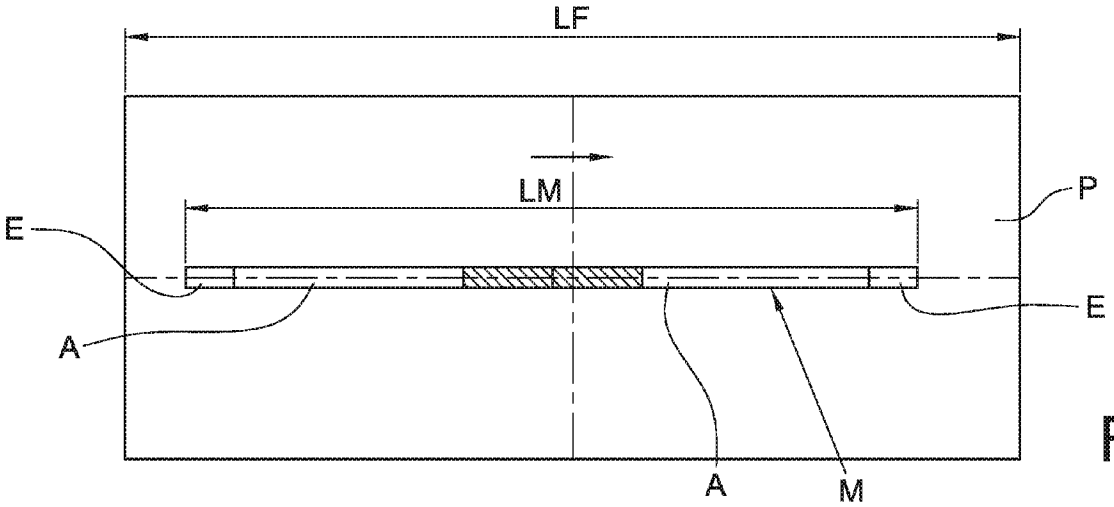
Figure 6D:
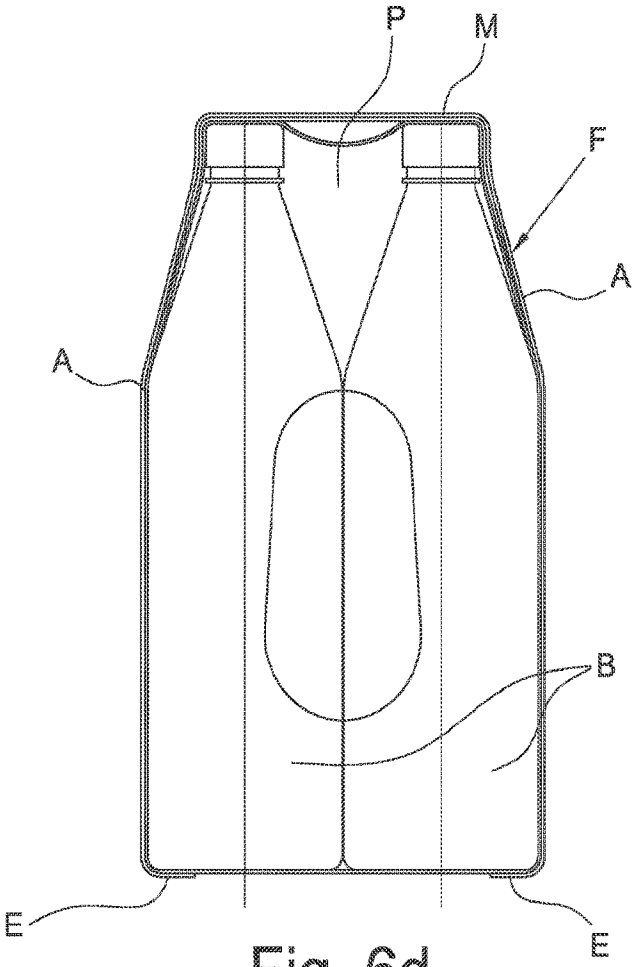
Figure 6C:
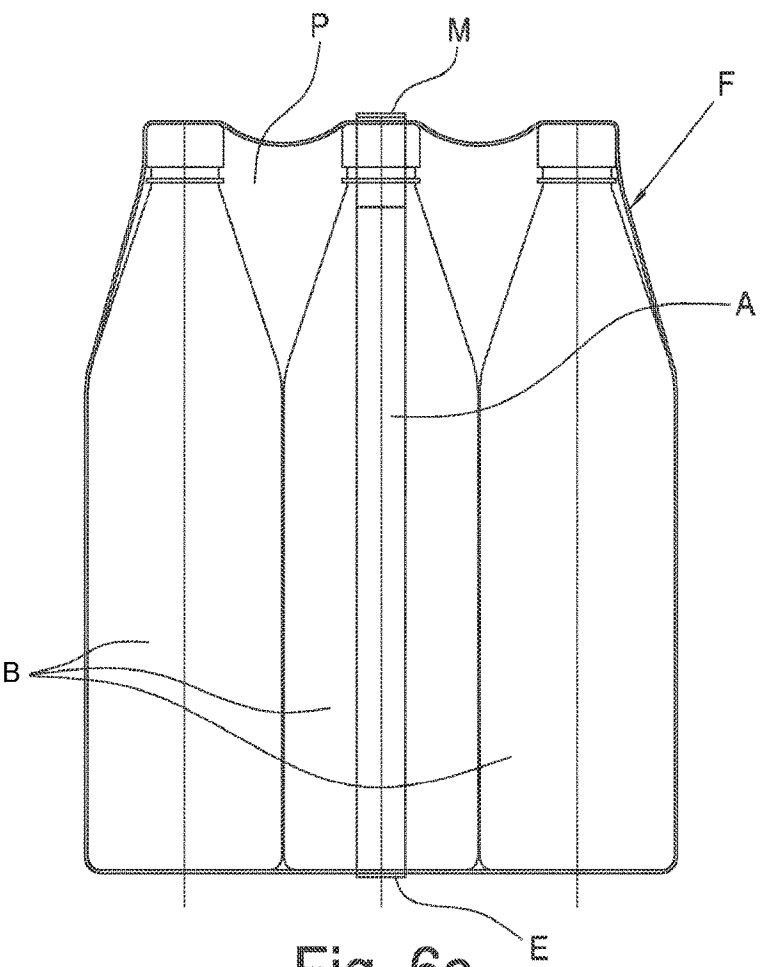

FIG. 6 is a representation of a second graph relative to the variations in velocity of a supporting tape of the application device according to FIG. 3 during the application of gripping handles, of different length with respect to those according to the graph of FIG. 5, to the respective packaging films for the formation of a second example embodiment of a bundle;

FIG. 6*b* is a schematic representation in plan of a packaging film P, corresponding to the graph according to FIG. 6*a*, provided with a respective gripping handle;

FIG. 6*c* is a side view of the first example embodiment of the bundle corresponding to the graph according to FIG. 6*a* and to the film according to FIG. 6*b;*

FIG. 6*d* is a front view of the bundle according to FIG. 6*c*.

Figure 1:
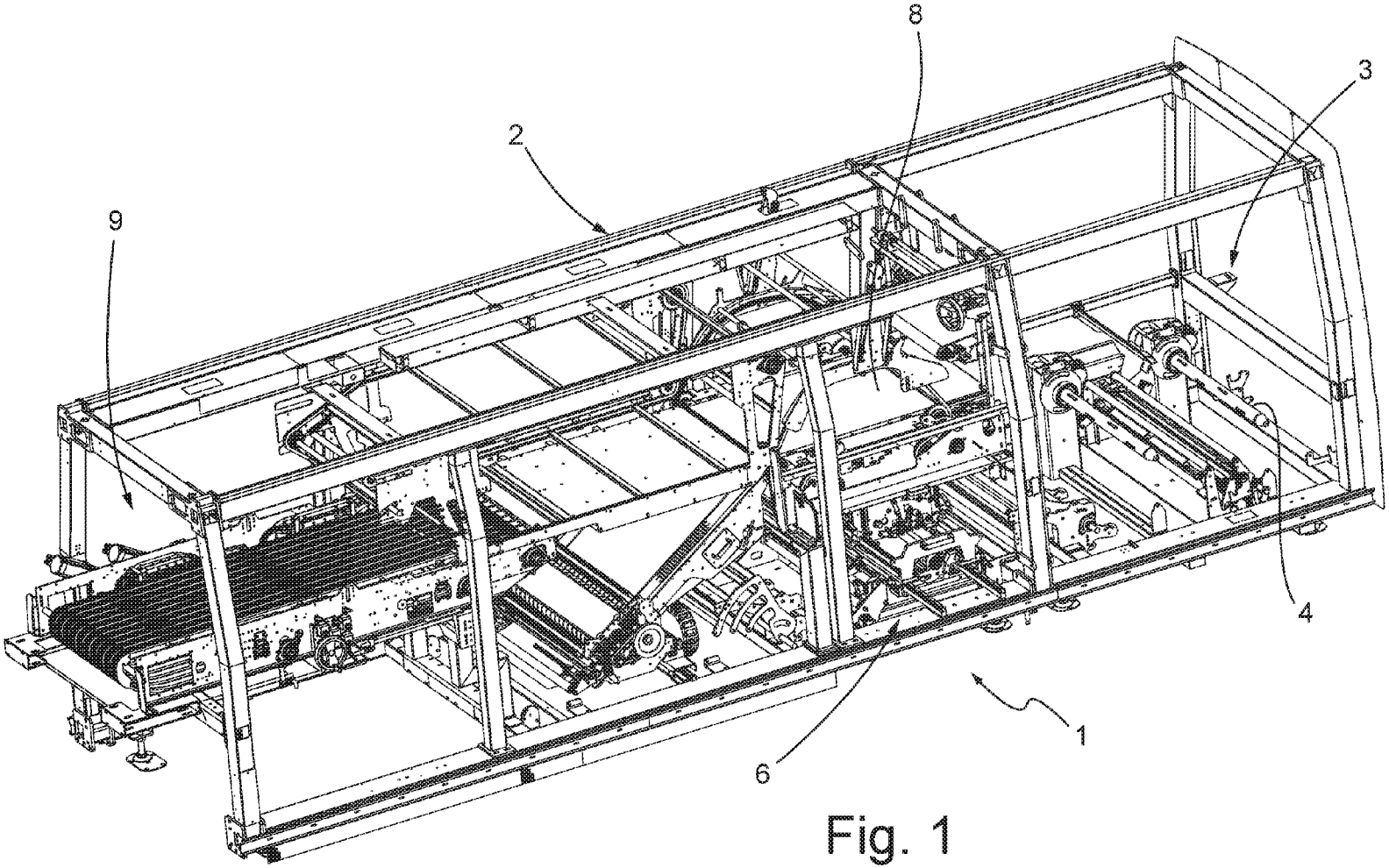
FIG. 1 is a general perspective view of a shrinkwrap packer on which a device for applying gripping handles on packaging films is mounted, in accordance with the present invention.
Figure 2:
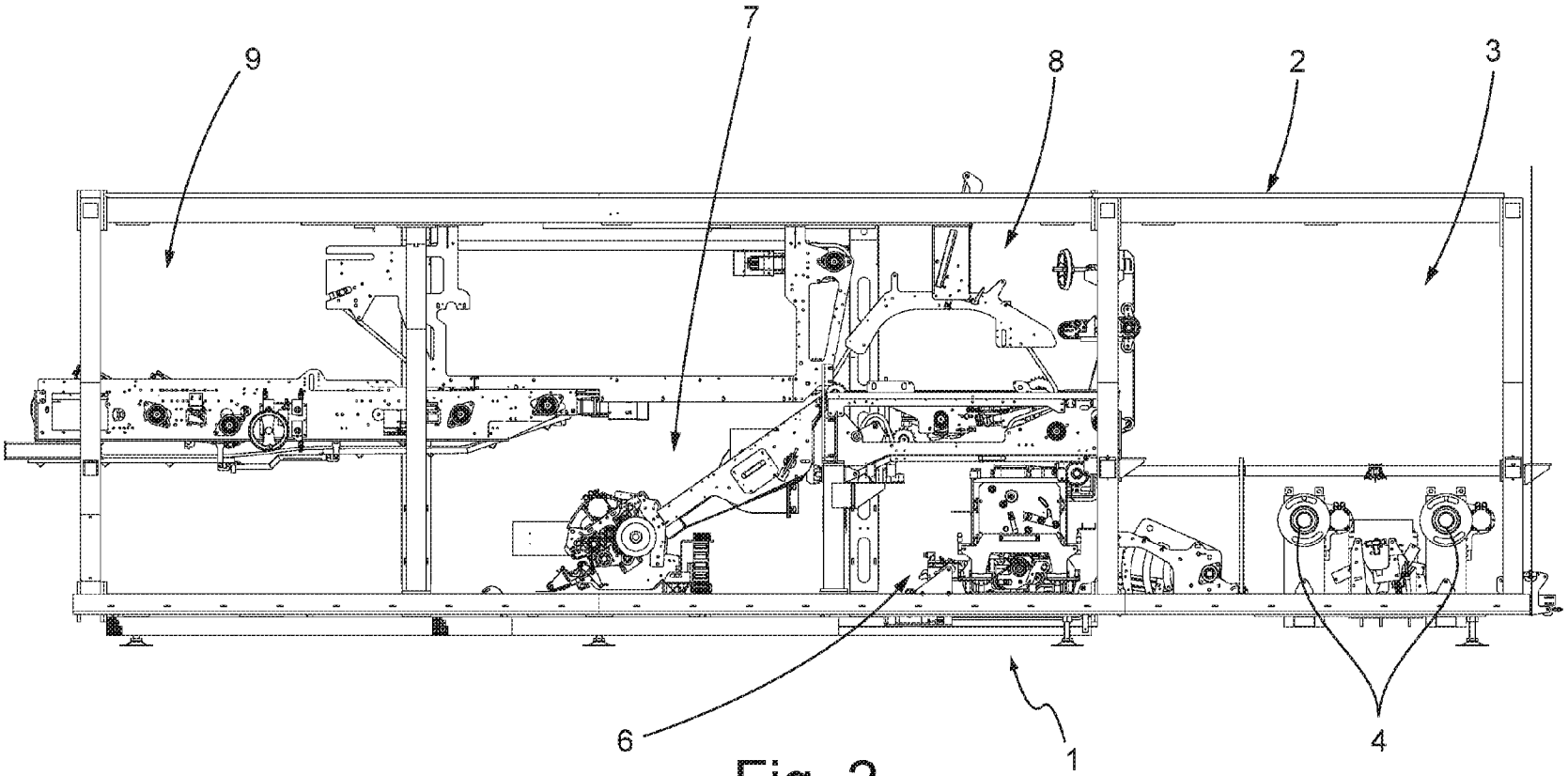
FIG. 2 is an elevational view of the shrinkwrap packer according to FIG. 1.

With reference to FIGS. 1 to 3, reference numeral 1 wholly indicates a device for applying gripping handles on packaging films being supplied on respective shrinkwrap packers for the formation of bundles of bottles, cans and/or similar containers, in accordance with the present invention.

As can be seen in FIGS. 1 and 2, the application device 1 is mounted on a shrinkwrap packer 2 for the formation and packaging of bundles F (FIGS. 5*c*, 5*d*, 6*c* and 6*d*) of bottles B, cans and/or similar containers B.

As can be seen in FIGS. 1 and 2, the shrinkwrap packer 2 comprises a supplying station 3 provided with one or more supply reels 4 of a continuous tape 5 (FIG. 3), preferably made of a heat-shrinkable plastic material, on which a series of packaging films P are provided (FIGS. 5*b* and 6*b*), each intended for the formation of a respective bundle F.

Close to and downstream of the supplying station 3, a joining station 6 is provided, in which the aforementioned device 1 for applying the gripping handles M (FIGS. 5*b* and 6*b*) to the packaging films P is operatively arranged.

Close to the joining station 6 and downstream thereof, a launching station 7 is operatively arranged, which sends the continuous tape 5 and, consequently, the packaging films P, obtained from it through corresponding cutting operations, equipped with the respective gripping handles M, towards a coupling station 8 preferably arranged on a different level.

At the coupling station 8 each packaging film P, previously cut from the continuous tape 5 in the launching station 7, is wound around a respective set of containers B that come from a respective supplying station 9.

Close to the coupling station 8 and downstream thereof, a heating station (not represented in the attached figures) is provided, at which each packaging film P, previously wound around a respective set of containers B, is heated to deform and shrink onto the containers B themselves forming the respective bundle F.

The bundles F exiting from the heating station are conveyed, through known means that are not represented, to a collection and storage station, also not illustrated.

Figure 4:
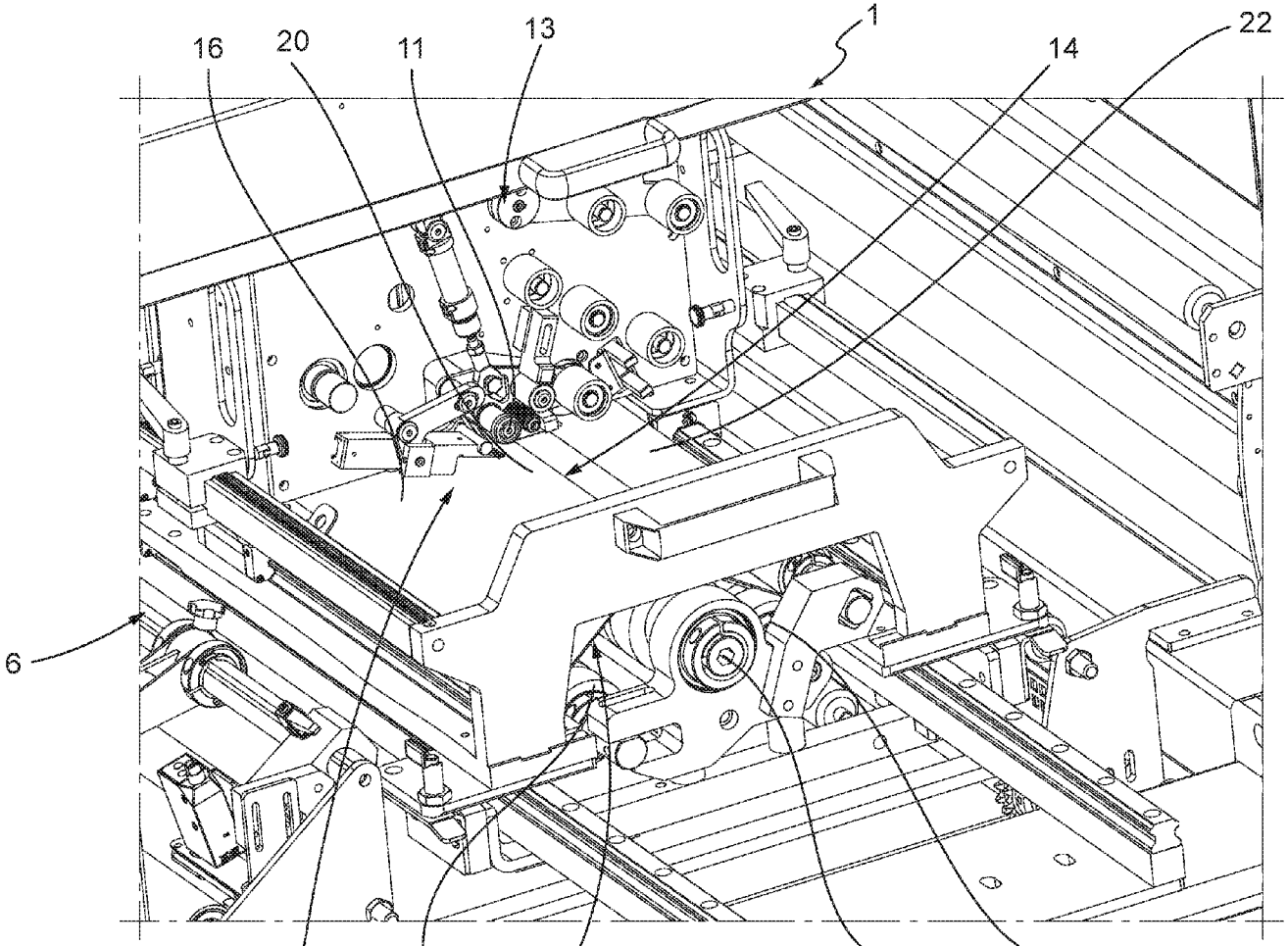
FIG. 4 is an enlargement of the shrinkwrap packer according to FIG. 1 in which the application device according to FIG. 3 is in the foreground.

As can be seen in FIGS. 3 and 4, the application device 1 of the aforementioned joining station 6 comprises at least one applying head 10 provided with at least one application roller 11 of a plurality of gripping handles M, supplied, in the form of continuous tape 12 subsequently cut into sections, through a series of transmission means 13 and similar transmission mechanisms operatively associated with the applying head 10.

Again with reference to FIGS. 3 and 4, the application device 1 of the joining station 6 comprises at least one abutment mechanism 14 for operatively supporting the packaging films P supplied in the form of a continuous tape 5 in the shrinkwrap packer 2 described above.

The applying roller 11 of the applying head 10 and the abutment mechanism 14 are mobile relative to one another between a non-operating condition, in which they are spaced apart and the packaging films P being supplied advance on the abutment mechanism 14, and an operating condition (FIG. 3), in which the applying roller 11 is arranged, at the abutment mechanism 14, against a respective packaging film P to apply a respective gripping handle M on the latter.

In detail, the applying roller 11 of the applying head is mobile in toward and away between the non-operating condition and the operating condition to apply a respective gripping handle M on each packaging film P being supplied.

Advantageously, the abutment mechanism 14 comprises at least one supporting tape 15, preferably wider than the width of the packaging films being supplied, having an advancement surface 16 that at least partially faces the applying head 10 for the advancing of the packaging films P being supplied on the shrinkwrap packer 2.

The advancement surface 16 of the supporting tape 15 provides, in the operating condition, an abutment for the applying roller 11 of the applying head 10. The latter, acting directly against the advancement surface 16 of the supporting tape 15, is able to apply a respective gripping handle M on each packaging film P being supplied.

In detail, during the application of each gripping handle M to the respective packaging film P, suitable joining adhesive portions A thereof ensure its engagement.

As can be clearly seen in the diagram represented in FIG. 3, the supporting tape 15 extends according to a ring-shaped development, preferably substantially triangular.

The supporting tape 15 is advantageously moved according to the same advancing direction of the packaging films being supplied to accompany the packaging films along the applying head 10 and, consequently, along the joining station 6.

Going into greater detail, the supporting tape 15 is provided with at least one moving roller 17, operatively engaged to the supporting tape 15 on the opposite side with respect to the advancement surface 16. The moving roller 17 is configured to activate the supporting tape 15 in movement according to the advancement direction of the packaging films P.

The supporting tape 15 is also provided with a first idle roller 18 operatively arranged upstream of the moving roller 17 in the advancement direction of the packaging films P being supplied.

The first idle roller 18 also engages the supporting tape 15 on the opposite side to the advancement surface 16.

The supporting tape 15 is also provided with a second idle roller 19, operatively arranged downstream of the moving roller 17 in the advancement direction of the packaging films P being supplied. Similarly to the other moving roller 17 and idle roller 18, the second idle roller 19 also engages the supporting tape 15 on the opposite side to the advancement surface 16 providing the latter with a suitable support structure. Again with reference to FIG. 3, the moving roller 17 is advantageously arranged between the applying roller 11 of the applying head 10 and the idle rollers 18, 19 so that the triangular ring-shaped development of the supporting tape 15 has an abutment rounded vertex 20 arranged at the applying head 10 and two transmission vertices 21, 22, also rounded, spaced from the latter.

The abutment rounded vertex 20 defines the apex of the triangular structure determined by the supporting tape 15, whereas the rounded transmission vertices 21, 22 define the base thereof.

Again with reference to FIGS. 3 and 4, the device 1 comprises at least one counter-roller 22' operatively active on the advancement surface 16 of the supporting tape 15 at the first idle roller 18. The counter-roller 22' presses the packaging films P being supplied against the advancement surface 16 of the supporting tape 15 being moved, to ensure the adhesion of the latter during the advancement.

Alternatively, as illustrated with a broken line in FIG. 3, the counter-roller 22' can be operatively arranged at the second idle roller 19 to press the packaging films P against the advancement surface 16 of the supporting tape 15 before the packaging films P separate from the latter to be guided towards the launching station 7 of the shrinkwrap packer 2.

As can be seen in the diagram of FIG. 3, the advancement surface 16 of the supporting tape 15 has a first flat rectilinear section **16*a* defined between the first idle roller 18 and the moving roller 17 and a second flat rectilinear section 16*b* defined between the moving roller 17 and the second idle roller 19**.

Advantageously, the packaging films P being supplied are free to translate, along the advancement direction thereof, with respect to the advancement surface 16 of the supporting tape 15 downstream of the counter-roller 22'.

In particular, the presence of rectilinear sections **16*a*, 16*b*, at which there are no forces directed perpendicularly to the packaging films P and to the supporting tape itself so that there are no tangential friction actions directed longitudinally along the advancement direction of the packaging films P and of the supporting tape 15**, allows relative sliding between the latter, especially in the operating condition, in other words during the application of the gripping handles M to the packaging films P being supplied.

In particular, the configuration provided and illustrated in FIGS. 3 and 4 allows microsliding between the packaging films P being supplied and the advancement surface 16 of the supporting tape 15 at the application area of the gripping handles M, in other words at the applying roller 11 of the applying head 10.

On the other hand, at the vertices 20, 21 and 22 defined by the respective moving roller 17 and idle rollers 18, 19, the friction forces between the supporting tape 15 and the packaging films P being supplied are such as to ensure the adhesion between them up to a maximum limit advancement velocity threshold of the supporting tape 15. In this way, the supporting tape 15 is able to carry, both in acceleration and in deceleration, the packaging films P engaged on it. Once the aforementioned maximum advancement velocity threshold of the supporting tape 15 has been exceeded, the packaging films P carried by it tend to slide slightly also at the curvilinear sections defined by the vertices 20, 21 and 22.

According to an advantageous aspect of the present invention, the moving velocity of the supporting tape is variable to improve the application of the gripping handles M, especially at high advancement velocities of the corresponding continuous tape 5 being supplied on the shrinkwrap packer 2.

In detail, it is possible that the velocity of the supporting tape 15 to be variable between a minimum limit, at which ends E of the joining adhesive portions A of the gripping handle M being applied adhere to the respective packaging film P, and a maximum limit, at which the packaging film P is not superimposed to the gripping handle M as occurs in the initial and final sections of the packaging films P being supplied or at the central area of the gripping handle M being applied comprised between the ends E. Of course, the passing from the minimum limit to the maximum limit and vice-versa requires, respectively, an acceleration and a deceleration of the supporting tape 15 nevertheless ensuring a constant average velocity VM preferably corresponding to the advancement velocity of the packaging films P in the form of continuous tape 5.

Advantageously, the maximum limit is in turn variable so as to be able to take up, according to the variations in length of the packaging films 2 and of the gripping handles M, in the time intervals of the advancement velocities and in the average velocity VM of the packaging films 2, different values greater than the minimum limit.

As can be seen in FIG. 3, the device 1 advantageously comprises a first compensation chamber 23, optionally provided with a plurality of transmission rollers 23*a* that are mobile with respect to one another. The first compensation chamber 23 is operatively arranged upstream of the first idle roller 18 in the advancement direction of the packaging films P being supplied on the shrinkwrap packer 2. The first compensation chamber 23 is suitable for compensating for the velocity and/or stretch variations at which the packaging films P are subjected to during the application of the gripping handles M between the non-operating condition and the operating condition of the applying head 10.

The interposition of the first compensation chamber 23 makes it possible to move the continuous tape 5 of the packaging films P at variable velocities at the applying head 10 whilst ensuring that the respective supply reel 4 of the supplying station 3 is unwound at a constant velocity.

The device 1 also comprises a second compensation chamber 24, optionally provided with a plurality of transmission rollers 24*a* that are mobile relative to one another. The second compensation chamber 24 is operatively arranged downstream of the second idle roller 19, in the advancement direction of the packaging films P being supplied on the shrinkwrap packer 2. Similarly to the first compensation chamber 23, the second compensation chamber 24 is suitable for compensating for the velocity and/or stretch variations at which the packaging films P are subjected to during the application of the gripping handles M between the non-operating condition and the operating condition.

The interposition of the second compensation chamber 24 also allows velocity variations of the continuous tape 5 of the packaging films P at the applying head 10, at the same time ensuring advancement thereof at variable velocity according to what is required by a shrinkwrap packer in correspondence of the launching station 7.

The present invention also concerns a method for applying gripping handles M on packaging films P in the form of continuous tape 5 being supplied on a shrinkwrap packer 2.

The method firstly comprises the provision of the aforementioned applying head 10, then, the provision of the abutment mechanism 14, which must be operatively arranged at the applying head 10 to support, in advancement, the packaging film P being supplied.

The gripping handles M are supplied to the applying head 10, while the packaging films P are guided towards the abutment mechanism 14.

At the applying head 10, the packaging films P advance between the latter and the abutment mechanism 14.

When each packaging film P is at the applying head 10 a respective gripping handle M, provided with corresponding joining adhesive portions A, is applied on the same through a pressure exerted by the applying head 10.

Advantageously, since the abutment mechanism 14 comprises the supporting tape 15 described above provided with the advancement surface 16 having flat rectilinear sections 16*a*, 16*b*, the packaging films P are supported along the entire path that the continuous tape 5 follows at the applying head 10.

Advantageously, the advancement surface 16 defines an abutment that interacts with the applying head 10 to ensure the optimal engagement of the joining adhesive portions A of the gripping handles M being applied to the respective packaging films P.

During the entire application method, the supporting tape 15 is moved according to the same advancement direction of the packaging films P being supplied to pull and accompany the latter along the applying head 10.

In particular, as can be seen in FIG. 3, the packaging films P coming from the supplying station 3 of the shrinkwrap packer 2 intercept the supporting tape 15 at the first idle roller 18.

In the case in which the application device 1 is provided with a counter-roller 22' arranged at the first idle roller 18, the packaging films P and the supporting tape 15 follow a first curvilinear section until the counter-roller 22' itself is reached, which, through an appropriate pressure action, ensures the sufficient adhesion of the packaging films P to the supporting tape 15.

In the case in which the application device 1 is provided with a counter-roller 22' arranged at the second idle roller 19, the packaging films P and the supporting tape 15 follow the first curvilinear section together with the latter until the first rectilinear section 16*a* of the advancement surface 16 is reached.

The packaging films P and the supporting tape 15 thus advance along the first flat rectilinear section 16*a* of the advancement surface 16 until they pass over the moving roller 17 against which the applying roller 11 of the applying head 10 operates to deposit a respective gripping handle M.

The application of each gripping handle M, in particular of the joining adhesive portions A thereof, on the respective advancing packaging film P tends to slow down the packaging films P downstream of the first idle roller 18.

In such a situation, the packaging films P can be subject to micro-sliding with respect to the supporting tape 15 at the applying head 10, in other words at the area in which the gripping handles M are applied to the respective packaging films P being supplied.

In particular, since each gripping handle M is substantially immobile during its application to the respective packaging film P that proceeds at high velocity on the advancement surface 16 of the supporting tape 15, the gripping handle M firstly undergoes an elastic deformation, to then be pulled to the same advancement velocity as the respective packaging film P to which it is applied. Consequently, at the moment when each gripping handle is applied to a respective packaging film, the latter undergoes an inevitable slowing down due to the braking effect of the gripping handle M to be pulled.

Advantageously, the packaging films P can slide slightly on the advancement surface 16 of the supporting tape 15 downstream of the first idle roller 18, especially at the applying head 10, so as to compensate the stresses generated during the application action carried out by the applying head 20.

Once a gripping handle M has been applied to the respective packaging film P, the latter advances, together with its own gripping handle M, along the second flat rectilinear section 16*b* of the advancement surface 16 of the supporting tape 15 until a curvilinear final section is reached, localised at the second idle roller 19.

In the case in which the application device is provided with a counter-roller 22' arranged at the first roller 18, the packaging films P provided with the respective gripping handles M follow the final curvilinear section together with the supporting tape 15 to separate from the latter and proceed towards the launching station 7 of the shrinkwrap packer 2, while the supporting tape proceeds in the opposite direction to again intercept the packaging films P being supplied at the first idle roller 18 and the counter-roller 22'.

In the case in which the application device 1 is provided with a counter-roller 22' arranged at the second idle roller 19, the packaging films P provided with the respective gripping handles M follow the final curvilinear section and intercept the counter-roller 22' that exerts a constant pressure action against the support roller 15 ensuring the adhesion of the packaging films P to the latter. The packaging films P then separate from the supporting tape 15 to proceed in the direction of the launching station 7, while the supporting tape 15 proceeds in the opposite direction to again support, at the first idle roller 18, the packaging films P coming from the supplying station 3. Advantageously, the moving velocity of the supporting tape 15 is at the same time variable in order to ensure high advancement velocities of the packaging films P and optimal adhesion of the joining adhesive portions A of the gripping handles M thereto.

In detail, the moving velocity of the supporting tape is variable between a minimum limit and a maximum limit. The maximum limit is in turn variable between different values higher than the minimum limit and can vary according to the production requirements of the packaging.

As can be seen in the graphs according to FIGS. 5*a* and 6*a*, the moving velocity of the supporting tape 15 is variable between a minimum limit, at which at least the ends E of the joining adhesive portions A of each gripping handle M being applied adhere to the respective packaging film P, and a maximum limit, in which the supporting tape 15 proceeds faster.

With reference to the graph represented in FIG. 5*a*, the maximum limit V2 corresponds to the initial and final sections of each packaging film P being supplied. In other words, the maximum limit V2 corresponds to the portions of each packaging film P not passed over by the respective gripping handles M being applied.

On the other hand, with reference to the graph represented in FIG. 6*a*, the maximum limit V2 corresponds to the central area of the gripping handle M. A third advancement velocity V3 higher than the first advancement velocity V1 and preferably less than or equal to the second advancement velocity V2 corresponds to the initial and final sections of each packaging film P being supplied not passed over by the respective gripping handles M being applied.

Again with reference to FIG. 5*a*, the supporting tape 15 is moved at a first advancement velocity V1 preferably corresponding to the entire length LM of the respective gripping handle M being applied.

Once the application of the gripping handle M has ended, the supporting tape 15 is accelerated until a second advancement velocity V2 is reached, higher than the first advancement velocity V1.

The second advancement velocity V2 is maintained for a predetermined time interval T, which corresponds to an end section of the packaging film P free from the gripping handle M applied and to an initial section of the subsequent packaging film P, without gripping handle M.

Thereafter and before the adhesion of the gripping handle M to the subsequent packaging film P, the supporting tape 15 is decelerated until the first advancement velocity V1 is reached.

The acceleration, maintenance and deceleration correspond to an end section of the packaging film P free of the gripping handle M applied and to an initial section of the subsequent packaging film P, without gripping handle.

Such a mode of oscillation of the advancement velocity of the supporting tape 15 is particularly suitable for allowing optimal application of conventional gripping handles M, in other words configured to engage structural portions of the packaging films P corresponding to the sides of the corresponding bundles F in formation (FIGS. 5*c* and 5*d*) in just the upper part thereof.

In the case in which it is necessary to reduce the thickness and, consequently, the overall mass of the packaging films P thus weakening them, longer gripping handles M are applied (FIGS. 6*b* to 6*d*) the joining adhesive portions A of which engage structural portions of the respective packaging films P corresponding to the bottom of the bundles F formed (FIGS. 6*c* and 6*d*). Therefore, these are handles of slightly shorter length than the length LF of each packaging film P.

In this case, as can be seen in the graph of FIG. 6*a*, the supporting tape 15 is moved to advance at a first advancement velocity V1 that is maintained for a first time interval T1 sufficient for the application of the respective end E of a first joining adhesive portion A of a respective gripping handle M being applied on a corresponding packaging film P.

Thereafter, the supporting tape 15 is accelerated, during the depositing step of the first joining adhesive portion A, until a second advancement velocity V2 is reached, higher than the first advancement velocity V1. The second advancement velocity V2 is maintained for a second time interval T2 corresponding to the central area of the gripping handle M being applied. The supporting tape 15 is then decelerated from the second advancement velocity V2 to the first advancement velocity V1 close to the end E of the second joining portion A of the gripping handle M being applied at which the cutting operation of the gripping handle M itself is carried out from the corresponding continuous tape 12 being supplied along the applying head 10.

The first advancement velocity V1 is maintained for a third time interval T3 sufficient for the application of the end E of the second joining portion A of the respective gripping handle M.

Thereafter, the supporting tape 15 is again accelerated until a third advancement velocity V3 is reached, higher than the first advancement velocity V1 and preferably less than or equal to the second advancement velocity V2, corresponding to an end section of the respective packaging film P free from the gripping handle M applied, in order to be subsequently decelerated until the first advancement velocity V1 is reached, corresponding to an initial section of the subsequent packaging film P, without gripping handle M. The first and the second compensation chamber 23, 24 react suddenly to any variation in tension and/or velocity present along the continuous tape 5 on which the packaging films P are defined so as to adapt the unwinding of the supply reels 4 of the supplying station 3, at constant velocity, and the subsequent launching station 7 to the variations that the packaging films P undergo in the joining station 6.

The application device 1, the shrinkwrap packer 2 and the relative application method solve the problems encountered in the prior art and achieve important advantages.

In particular, the use of a substantially rectilinear and flat mobile supporting tape that operates as an abutment element for the applying head makes it possible to achieve an optimal adhesion of the joining adhesive portions of the gripping handles to the advancing packaging films.

The elimination of the transversal wrinkles is also obtained by means of the velocity variations of the supporting tape that is slowed down during the application of the joining adhesive portions of the gripping handles and subsequently accelerated to maintain a high average advancing velocity.

The elimination of the transversal wrinkles allows a significant increase in the structural strength of the bundles at the joins between the gripping handles and the packaging films. Consequently, the bundles obtained are no longer subject to undesired detachment of the gripping handles from the packaging films during the handling thereof.

The management of the advancement velocity of the supporting tape as a function of the application of the joining adhesive portions of the gripping handles ensures the structural integrity of the packaging films during the application operation. In particular, the packaging films are no longer subject to excessive structural deformations during the application of the gripping handles so that they no longer undergo permanent deformations, breaks or tears. Consequently, the continuity of the production process is ensured, avoiding undesired interruptions thereof and the amount of waste is drastically reduced.

It should also be considered that, in accordance with the present invention, the overall application speeds of the gripping handles to the packaging films can be substantially increased whilst still ensuring, on the one hand, the optimal application of the gripping handles, and on the other hand, the structural integrity of the packaging films.

The increase in application velocities of the gripping handles allows an overall increase of the production speed of the bundles that corresponds to an overall reduction of the production costs thereof.

Finally, it should be noted that the application device thus conceived allows a significant reduction in the thickness and grammage of the packaging films whilst at the same time ensuring the structural integrity thereof during the application operations of the gripping handles.

The invention claimed is:

1. Device for applying gripping handles on heat-shrinkable packaging films, being supplied on shrinkwrap packers for making bundles of bottles and/or cans, the applying device comprising:

at least one applying head provided with at least one roller for applying a plurality of gripping handles supplied in the form of a continuous tape and subsequently cut into sections;

at least one abutment mechanism for operatively supporting a plurality of packaging films in the form of a continuous tape and subsequently cut into sections, optionally heat-shrinkable, being supplied on a respective shrinkwrap packer on which the applying device is mounted, the roller for applying of the applying head and the abutment mechanism being movable with respect to one another between a non-operating condition, in which the roller for applying of the applying head is spaced apart from the abutment mechanism, and an operating condition, wherein the roller for applying of the applying head is arranged, at the abutment mechanism, against at least one of the packaging films being supplied for applying a respective gripping handle on such packaging film, wherein the abutment mechanism comprising at least one supporting tape, higher than the width of the packaging films being supplied, having an advancement surface facing, at least partially, the applying head for advancing the packaging films being supplied on the shrinkwrap packer, the advancement surface of the supporting tape providing, in the operating condition, an abutment for the roller for applying of the applying head, the roller for applying of the applying head applying a gripping handle on each packaging film being supplied, against the advancement surface of the supporting tape; and wherein the supporting tape extends according to a ring-shaped development, substantially triangular, the supporting tape being movably actuated according to the same advancement direction of the packaging films being supplied on the shrinkwrap packer for carrying these packaging films in advancing along the applying head.

2. Device according to claim 1, wherein the supporting tape is provided with:

at least one moving roller, operatively engaged to the supporting tape on the opposite side with respect to the advancement surface, the moving roller movably actuating the supporting tape according to the advancement direction of the packaging films being supplied on shrinkwrap packer;

a first idle roller operatively arranged upstream of the moving roller in the advancement direction of the packaging films being supplied, the first idle roller engaging the supporting tape on the opposite side with respect to the advancement surface;

a second idle roller, operatively arranged downstream of the moving roller in the advancement direction of the packaging films being supplied and engaging the supporting tape on the opposite side with respect to the advancement surface, the moving roller being interposed between the roller for applying of the applying head and the idle rollers, whereby the ring-shaped development of the supporting tape has a abutment rounded vertex arranged at the applying head and two transmission vertices spaced apart from the applying head and defining a base of the supporting tape having a ring-shaped triangular development.

3. Device according to claim 2, further comprising a counter-roller operatively active on the advancement surface of the supporting tape at the first idle roller or at the second idle roller, the counter-roller pressing the packaging films being supplied against the advancement surface of the supporting tape being moved to ensure the adhesion of the counter-roller, of the packaging films and of the supporting tape.

4. Device according to claim 3, wherein said advancement surface of the supporting tape has:

a first flat rectilinear section defined between the first idle roller and the moving roller;

a second flat rectilinear section defined between the moving roller and the second idle roller, the packaging films being supplied being free to translate, along the advancement direction, with respect to the advancement surface of the supporting tape between the first and second idle rollers, in the operating condition.

5. Device according to claim 2, comprising:

a first compensation chamber, provided with a plurality of transmission rollers movable with respect to one another, operatively arranged upstream of the first idle roller, in the advancement direction of the packaging films being supplied on the shrinkwrap packer, for compensating for the velocity and/or stretch variations at which the packaging films are subjected during the application of the gripping handles between the non operating condition and the operating condition;

a second compensation chamber, provided with a plurality of transmission rollers movable with respect to one another, operatively arranged downstream of the second idle roller, in the advancement direction of the packaging films being supplied on the shrinkwrap packer, for compensating for the velocity and/or stretch variations at which the packaging films are subjected during the application of the gripping handles, between the non operating and the operating condition.

6. Device according to claim 2, wherein the moving velocity of the supporting tape can vary between a minimum limit, at which ends of corresponding joining adhesive portions of each gripping handle being applied adhere to the respective packaging film, and a maximum limit, at which the packaging film is not superimposed to the gripping handle being applied or corresponding to the central area of the gripping handle being applied, the maximum limit being variable to take up different values greater than the minimum limit.

* * * * *